United States Patent [19]

Menchetti et al.

[11] Patent Number: 4,574,547

[45] Date of Patent: Mar. 11, 1986

[54] WINDOW SYSTEM FOR DEMOUNTABLE WALLS

[75] Inventors: Robert J. Menchetti, North Olmsted; Robert H. Safran, Sheffield; Gale E. Sauer, North Olmsted, all of Ohio

[73] Assignee: Donn, Incorporated, Westlake, Ohio

[21] Appl. No.: 627,555

[22] Filed: Jul. 2, 1984

[51] Int. Cl.[4] ..... E04B 2/58

[52] U.S. Cl. ..... 52/238.1; 52/241

[58] Field of Search ..... 52/235, 238.1, 241, 52/122, 281

[56] References Cited

U.S. PATENT DOCUMENTS

| | | | |
|---|---|---|---|
| 2,766,855 | 10/1956 | Johnson et al. . | |
| 3,125,193 | 3/1964 | Brown et al. . | |
| 3,217,460 | 11/1965 | Downing, Jr. | 52/735 |
| 3,271,920 | 9/1966 | Downing, Jr. | 52/735 |
| 3,453,790 | 7/1969 | Harris | 52/143 |
| 3,548,557 | 12/1970 | Downing, Jr. | 52/493 |
| 3,566,559 | 3/1971 | Dickson | 52/122 |
| 3,922,764 | 12/1975 | Downing, Jr. | 24/259 |
| 4,103,463 | 8/1978 | Dixon | 52/122 |
| 4,188,758 | 2/1980 | Swann | 52/241 |
| 4,245,442 | 1/1981 | Durham | 52/122 |
| 4,361,994 | 12/1982 | Carver | 52/238.1 |

FOREIGN PATENT DOCUMENTS

| | | | |
|---|---|---|---|
| 1430451 | 3/1976 | United Kingdom | 52/238.1 |

*Primary Examiner*—J. Karl Bell

*Attorney, Agent, or Firm*—Pearne, Gordon, Sessions, McCoy, Granger & Tilberry

[57] ABSTRACT

A window system for demountable walls is disclosed which eliminates the necessity of custom-sizing of windows to compensate for variations in floor-to-ceiling spacing. The window system provides jacking means mounted on the lower window frame member which are operable to adjust the height of the window from the floor to compensate for variations in floor-to-ceiling spacing. A floor trim assembly includes cover plates which extend up and over the lower framing member and jacking system to obscure both from view. Such cover plates rest on the floor to provide a uniform height lower window trim that follows the floor line. A baseboard and upper trim system extends uniformly along the window and adjacent wall panels to provide an integrated window and wall system. The side framing members connect to sheet metal wall studs for additional strength and enclose the adjacent stud in instances in which windows are mounted adjacent to each other. The system allows the use of standard size, preglazed windows, but also allows field glazing when required.

10 Claims, 10 Drawing Figures

WINDOW SYSTEM FOR DEMOUNTABLE WALLS

BACKGROUND OF THE INVENTION

This invention relates generally to window mounting systems, and more particularly to a novel and improved window mounting system for use in demountable partition systems and the like.

PRIOR ART

Demountable partition systems are well known. Generally, such systems include channel-shaped floor and ceiling tracks which are respectively mounted on the floor and ceiling of a building structure. Metal studs are connected at their ends to said tracks, and the wall panels are supported by the tracks and studs. Trim, such as baseboard trim pieces, are substantially applied.

Examples of such demountable partition systems are illustrated in U.S. Pat. Nos. 3,125,193; 3,217,460; 3,271,920; 3,548,557; and 3,922,764. Such demountable partition systems are typically used for internal walls within a commercial building to provide offices, display rooms, and other types of separate working areas.

In some instances, jacking means are provided to adjust the height of panels. Examples of such systems are illustrated in U.S. Pat. Nos. 3,453,790; 3,566,559; 4,103,463; and 4,245,442.

In many instances, it is desirable to provide windows in such demountable partitions. Such windows may extend from floor to ceiling, or may extend only from a position spaced from the floor. Examples of demountable walls providing windows are illustrated in U.S. Pat. Nos. 3,766,855 and 3,125,193, supra.

Generally in the past, the window mounting structure has required an interruption in the demountable partition system, and has not been fully compatible with such system. Further, in many instances, such window mounting systems have required custom-size and shape glass and custom fitting of the various mounting components to the particular installation. Such custom fitting is often required because the floor-to-ceiling height is not completely uniform. For example, poured concrete floors are not precisely level, and the floor-to-ceiling space can vary considerably, even within a given area in a given building.

Custom-sizing of the glass can present severe problems and expense, particularly when tempered glass is required, since such glass must be first cut to size and then tempered. This results in considerable labor expense and time delays. Further, the custom fitting of the component materially increases the labor cost of installation.

Various sytems have been devised to reduce the custom fitting during installation of demountable partitions with windows combined therewith. However, such systems often are expensive and difficult to install. Further, such window mounting systems often are not fully compatible with the remaining demountable partition structure.

SUMMARY OF THE INVENTION

The present invention provides a novel and improved system combining a window mounting structure and a demountable partition structure in which full compatibility is provided. In such system, labor and manufacturing expense are considerably reduced.

There are a number of aspects of this invention. In accordance with one important aspect of the invention, the floor and ceiling tracks of the demountable partition extend past the window and constitute part of the window mounting structure. Consequently, the base mounting structure of the demountable partition is not interrupted at the window.

In accordance with another aspect of this invention, a novel and improved trim structure and window support structure are provided to compensate for variations in floor-to-ceiling spacing. Consequently, preglazed windows of standard sizes can be installed, and the need for custom-sizing of the window itself and custom-sizing of the mounting system is eliminated. This results in considerable reduction in cost of material and labor, and eliminates delays, particularly when tempered windows are involved.

In accordance with still another aspect of this invention, a typical demountable partition metal stud is incorporated into the side frame structure of the window to provide additional strength. Further, such side framing provides a neat joint with adjacent wall panels.

In accordance with still another aspect of this invention, a window framing system is provided which can be glazed in two different ways. One glazing system is particularly suited for factory glazing, and the other is particularly suited for on-site glazing at the time of installation or repair.

These and other aspects of this invention are illustrated in the accompanying drawings, and are more fully described in the following specification.

DETAILED DESCRIPTION OF THE DRAWINGS

Figure 1:
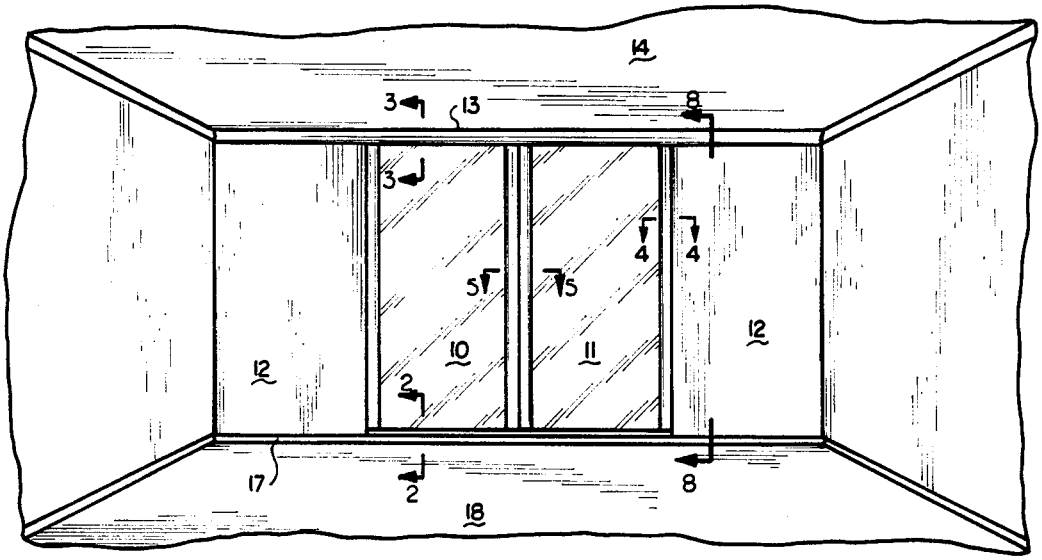
FIG. 1 is a perspective view, illustrating an installed demountable partition combined with windows in accordance with the present invention.

FIG. 1 illustrates a room providing a demountable wall system in accordance with the present invention in which floor-to-ceiling windows are provided in the demountable wall. The particular wall system illustrated includes two adjacent windows 10 and 11 positioned between wall panels 12. In such system, a channel-shaped ceiling track 13 is connected to the ceiling 14 and a channel-shaped floor track 16 (illustrated in FIG. 2 and FIG. 8). In a finished wall, the floor track 16 is concealed from view, and a baseboard 17 provides the wall trim along the floor 18. The ceiling track 13, however, provides the wall trim along the ceiling 14 and the sides of the ceiling track are visible in a completed wall system. It should be noted that the baseboard 17 and ceiling track 13 extend along both the panels and the windows 10 and 11 so that the floor and ceiling trim past the windows is virtually identical to the trim along the remaining portions of the wall.

In accordance with this invention, a system is provided for compensating for variations in the spacing between the ceilings and the floor so that the trim provided both along the top and the bottom of the window is of uniform width and follows the ceiling and floor, respectively. Any variations in the floor-to-ceiling height or spacing, therefore, appears in the exposed portion of the window and panels where it is not noticeable.

In order to accommodate variations in floor-to-ceiling spacing, a jacking system is provided to adjust the height of the window from the floor so that the top of the window is properly seated in the ceiling track. Further in accordance with this invention, the window structure is integrated into the wall system so that the same studs as are used along the panel portion of the walls are connected into the window trim to provide additional support for the window trim and to ensure a finished trim appearance along the joint between the window trim and the wall panels. Further in accordance with this invention, the structure is arranged so that standard sized, preglazed windows can be installed within a demountable wall system without special fitting or special sizing of the various components of the system. Still further in accordance with this invention, a structure is provided which permits the replacement of damaged windows in an existing wall without appreciable dismantling of the wall.

Figure 2:
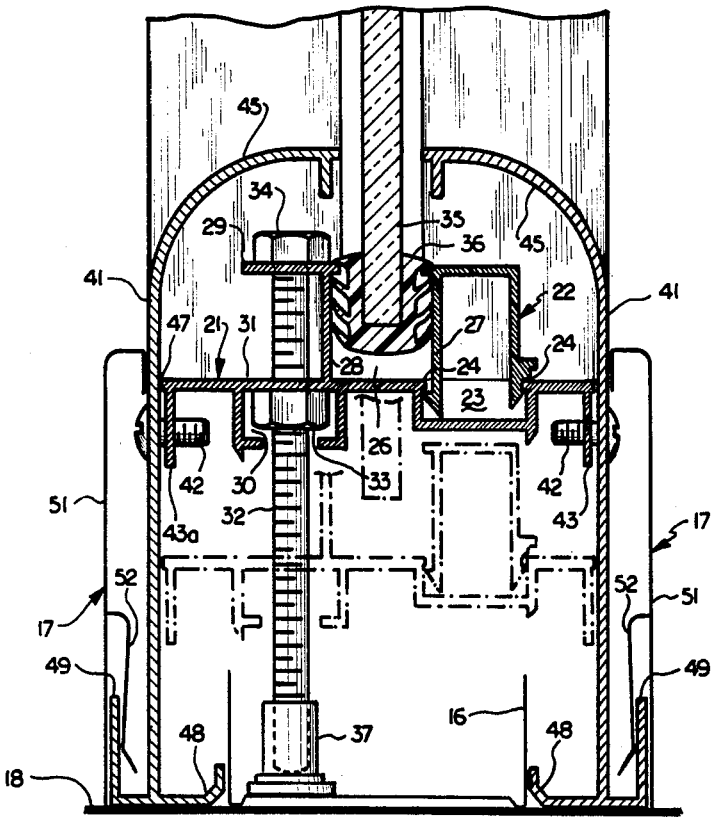
FIG. 2 is a fragmentary section, taken along line 2—2 of FIG. 1, illustrating the support system and trim provided at the bottom of the window.
Figure 2A:
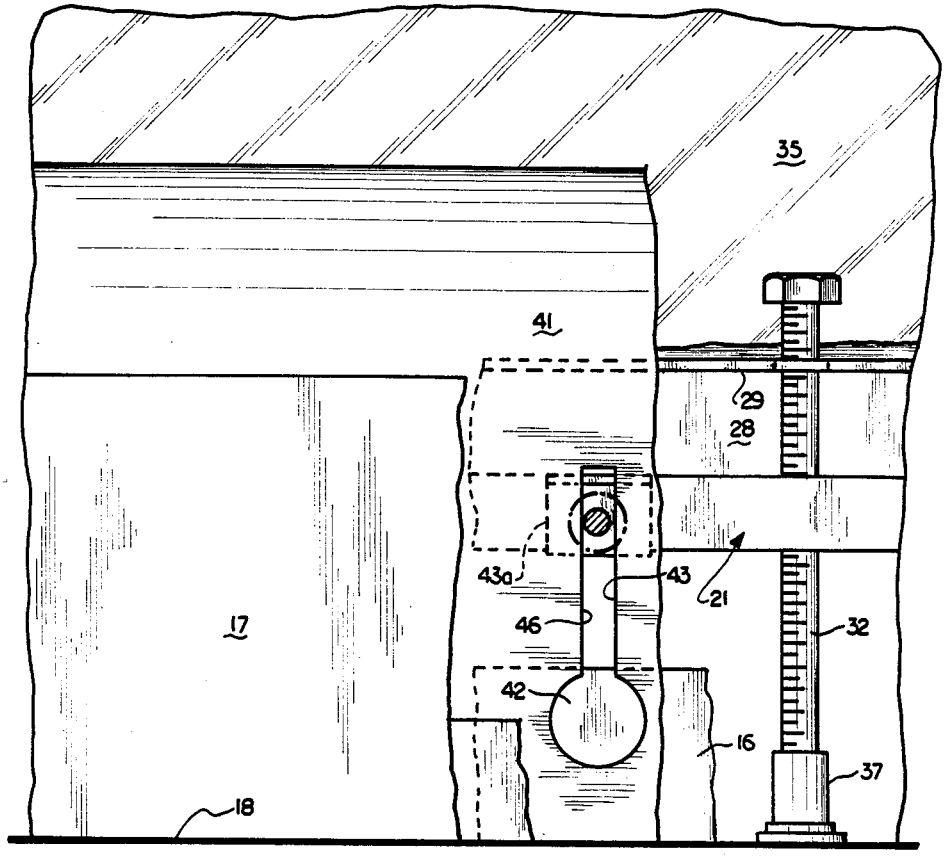
FIG. 2A is a side view, with portions broken away, illustrating the mounting and appearance of the trim along the base of the window.

FIGS. 2 and 2A illustrate the jacking system and trim structure along the bottom of the window. The jacking system and lower window glazing system include a lower frame assembly consisting of a main frame member 21 and an inverted U-shaped secondary frame member 22. Both of the frame members 21 and 22 are preferably extruded aluminum having a cross section best illustrated in FIG. 2. The main frame member 21 is formed with a longitudinally extending channel 23 with narrow, inwardly projecting lips 24 along the upper end of the channels. The secondary framing member 22 is sized to snap in under the lips to removably mount the secondary frame member 22 in the channel 23. The two framing members cooperate to provide an upwardly open, longitudinal channel 26 having one side wall 27 provided by the secondary frame member 22 and an opposite side wall 28 provided by the main frame member 21. Such opposite side wall also supports a lateral wall 29 spaced above the principal lateral wall 31 of the main frame member. Each of the walls 29 and 31 is formed with aligned openings at at least two spaced locations along the bottom of each window through which a jackscrew 32 extends. The main frame member also provides a downwardly open channel 30 proportioned to receive and trap a nut 33 through which each jackscrew is threaded. To assemble the jackscrew and nut, the nut is moved along the channel 30 into alignment with the openings through which the jackscrew is then inserted and the jackscrew is threaded down into the nut. Because the walls 29 and 31 are axially spaced along the jackscrew, the jackscrew is held in a vertical position parallel to the glass 35 of the window, and spaced to one side of the window so that the head 34 of the jackscrew is accessible during installation for adjustment by a conventional wrench, such as a ratchet wrench.

The edge of the glass 35 is suspended within the channel 26 by a glazing seal 36 which is extruded from a flexible plastic material such as polyvinyl chloride.

In FIG. 2, the jacking system is illustrated in full line at its upper extreme position of adjustment and is adjustable to such upper extreme position of adjustment from a lower position illustrated in phantom. The lower end of each jackscrew is provided with a pad 37 which rests on the bottom wall of the floor track. In FIG. 2, the floor track 16 is illustrated in the configuration of its initial manufacture for purposes of illustration. However, generally during installation, when the weight of the window is supported by the jackscrews, the bottom wall of the floor track usually distorts until it engages the floor surface 18. Such distortion, however, does not affect the mounting of the window system.

The framing members 21 and 22, along with the jackscrews 32, are enclosed in the finished system by cover members 41 and the baseboards 17, which are assembled on opposite sides of the window. Each of the cover members 41 is mounted by screws 42 which extend through a keyhole slot 43 (illustrated in FIG. 2A) and thread into a skirt **43*a* on the main frame member 21. This keyhole slot allows the cover member to be installed after the screws are loosely threaded into the skirt 43*a*, since the bottom of the keyhole slot is provided with an enlarged opening 44 through which the head of the screw 42 can pass. Further, because the keyhole slots provide an elongated, narrow slot portion 46, the screw can be accommodated in any adjusted position of the first frame member within the adjustment range of the system. Therefore, the cover members 41 can be dropped down into engagement with the floor 18 in any position of adjustment of the jacking system. It should be noted that above the skirt 43*a*, and therefore above the screw 42, the main frame member 21 is provided with a slight projection 47 so that when the screw 42 is tightened to securely mount the cover plate, the screw also biases the toe portion 48** of the cover plate into engagement with the floor track to ensure proper vertical positioning.

The cover plates 41 are also provided with an upstanding flange 49 which projects into the groove between the outer wall 51 and an inner mounting clip 52 on the baseboard 17, so that the baseboard is installed merely by pressing it down into the installed position illustrated. Further, the upper ends 45 of the cover members 41 are inwardly curved and extend the edges close to the glass 35. Therefore, the cover members 41 cooperate to fully enclose the framing members 21 and 22 and the entire jacking system. Since the baseboard extends up over the keyhole slot 43 and the screw 42, the baseboards 17 cooperate with cover members 41 to provide a complete finished trim.

Since the face of the side framing members is flat, the ends of the side plates 21 are cut square and form a neat joint with the side framing members 76. Similarly, the upper ends of the side framing members 76 form a neat joint with the top framing members 56. Further, since the spacing between the opposed faces of the side framing members 76 is uniform in the preglazed window, the side covers 41 can be precut to size and custom fitting is not required.

Figure 3:
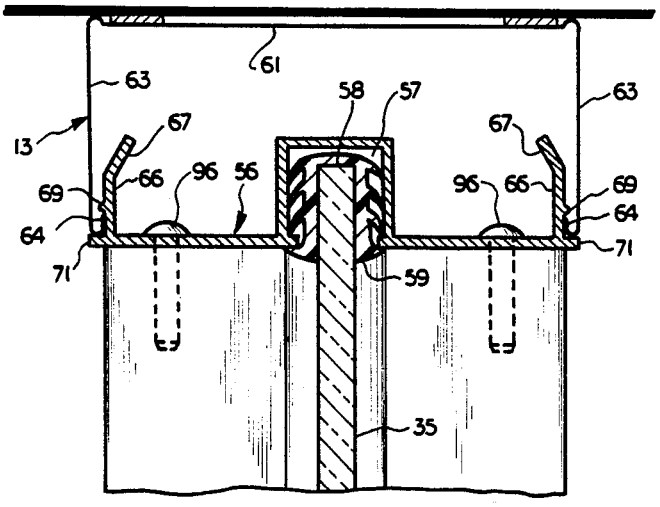
FIG. 3 is a fragmentary view, taken along line 3—3 of FIG. 1, illustrating the framing and trim along the top of the window.

FIG. 3 illustrates the mounting of the upper edge of the window. Mounted along the upper end of the window is an upper framing member 56 which is again an extrusion preferably formed of aluminum. Such extrusion provides a longitudinal channel 57 into which the upper edge 58 of the window 35 projects. Here again, a glazing seal 59 of the same structure as the glazing seal 36 is positioned over the edge of the glass and suspends the window within the channel 57.

The upper or ceiling track 13 is again channel-shaped, and provides a top wall 61 secured to the ceiling 62 and depending side walls 63 which extend to inturned hems 64. The upper framing member 56 is formed with upstanding legs 66 which project up past the hems and terminate at inwardly inclined camming portions 67. The upper framing member is installed by being raised up into the ceiling track 13, causing the track to be cammed open until a small lip 69 is positioned immediately above the hems 64 to lock the framing member in the track. Such movement is produced by the jackscrews 32 which are adjusted to raise the window until the upper framing member is snapped into the track as illustrated. In the installed position, the lips 69 coact with edge projections 71 which engage the lower edges of the side walls 63 to provide a trim appearance and to ensure that the framing member is properly installed within the ceiling track 13.

Figure 4:
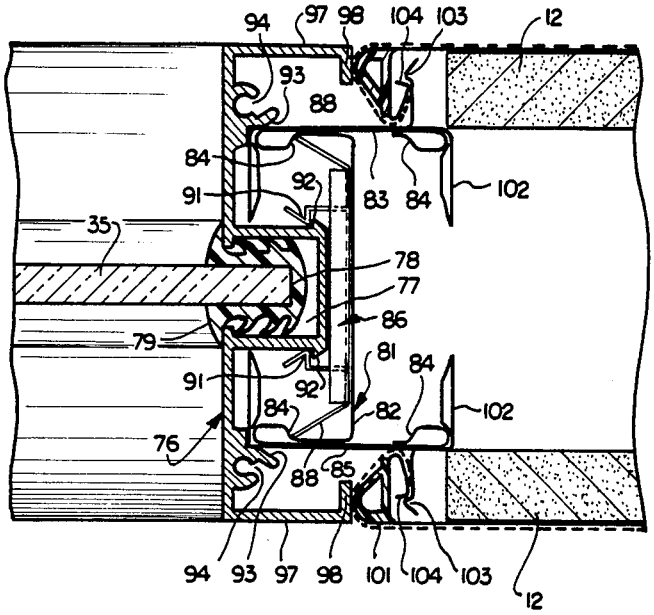
FIG. 4 is a fragmentary view, taken along line 4—4 of FIG. 1, illustrating a joint between the side of a window and a typical wall panel.
Figure 5:
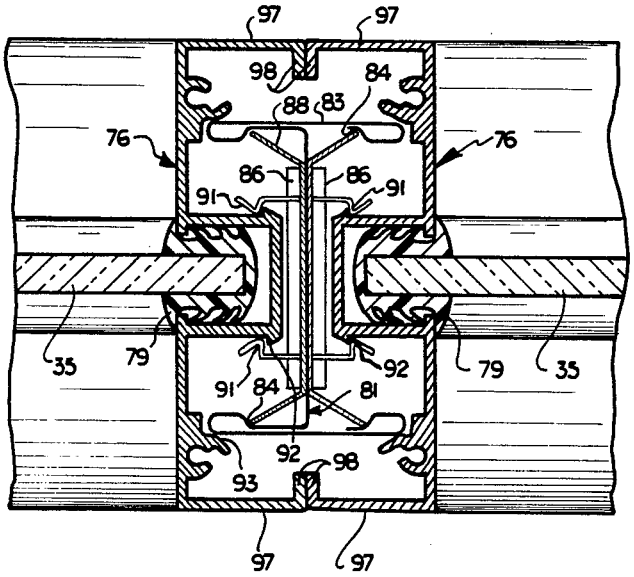
FIG. 5 is a fragmentary view, taken along line 5—5 of FIG. 1, illustrating the structure of the framing and mounting of two adjacent windows.
Figure 5A:
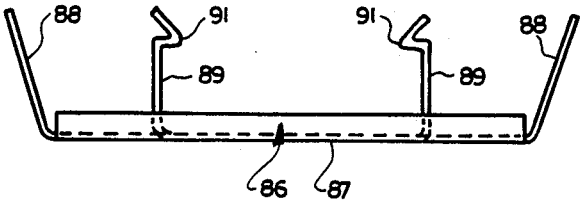
FIG. 5A is a view of the clip used to connect the side framing of the window and a sheet metal stud.

The side framing structure is illustrated in FIGS. 4, 5, and 5A. Mounted on the opposite sides of each of the windows is a side framing member 76 which is again preferably formed of an aluminum extrusion. Such member again provides a longitudinal channel 77 which receives the side edges 78 of the window glass 35. Here again, a glazing seal 79 having the same structure as the seal 36 is installed to extend around the edge of the glass and to seal with the walls of the channel 77. FIG. 4 illustrates the manner in which the side framing members connect to a stud 81 at a junction between a window 11 and panels 12. The stud 81 is an H-shaped sheet metal stud providing a central web 82 and substantially parallel, opposed flanges 83.

Such stud is supported, as described below, at its upper end within the ceiling track 13 and at its lower end within the floor track 16, and extends vertically within the wall. The stud is of a known configuration and is formed by bending sheet metal to the shape illustrated so that opposed shoulders 84 are provided on the inside of each of the flanges 83 at a location spaced from the lateral extremities thereof. The framing member 76 is attached to the stud 81 by metal clips 86 which are snapped into the stud at intervals along the length of the stud. Such clip has a structure best illustrated in FIG. 5A, and provides a planar base portion 87 which fits against the web 82 when installed in the stud. The clip also provides a pair of outer legs 88 which snap behind the shoulders 84 when the clip is installed in the stud to lock the clip in its installed position. Inner legs 89 provide opposed hook portions 91 which snap over lateral projections 92 on the framing member to lock the framing member in its installed position, as illustrated in FIGS. 4 and 5, to provide the connection between the studs 81 and the side framing members 76.

The side framing members 76 are also provided with lips 93 which closely fit the edges of the flanges 83 to provide additional support connections between the stud and the framing members. The side framing members are also provided with a longitudinally extending open groove 94 adjacent to the lip 93 which receives a self-tapping screw 96 (illustrated in FIG. 3) to fasten the side framing members to the upper and lower framing members so as to provide a rigidly connected framing structure for the window 11.

The side framing member 76 further provides a pair of skirts 97 which extend back from the face thereof to inturned flanges 98 so that the framing members are self-trimming. Such skirts provide the face trim structure for the side framing members and the skirts are sized so that they extend to the plane of the central web, and therefore enclose half of the stud.

In instances in which the side framing member extends along a joint between the window 11 and the panels 12, the panels abut the inturned flanges 98 to provide a neat joint between the window and the wall panels. The particular panels 12 illustrated in the drawings are provided with a soft edge at 101 and are secured to the stud 81 by spring clips 102 which embrace the adjacent flange 83 and provide a hook portion 103 which latches with a mating tab 104 provided by the panel. The particular panel structure with the soft edge and clip mounting is disclosed and claimed in copending application Ser. No. 512,242, filed July 11, 1983 (assigned to the assignee of the present invention) now U.S. Pat. No. 4,546,584, and such application is incorporated herein by reference for a detailed disclosure of such panel structures and the manner in which they are mounted.

In instances in which two windows 11 are mounted adjacent to each other, an assembly as illustrated in FIG. 5 is provided. In such case, clips 86 are provided on both sides of the associated stud 81 and the two adjacent side framing members 76 of the adjacent windows 11 are connected to the stud in an identical but opposite manner. Further, in such an installation, the skirts 97 of the two adjacent side framing members abut to totally enclose the stud and provide a finished trim at such junction. The metal studs associated with the side framing members cooperate to provide additional strength for the assembly and in the instance in which two windows abut, the side framing members are interconnected by the stud and cooperate with each other and the stud to provide a very strong and stable assembly.

Figure 8:
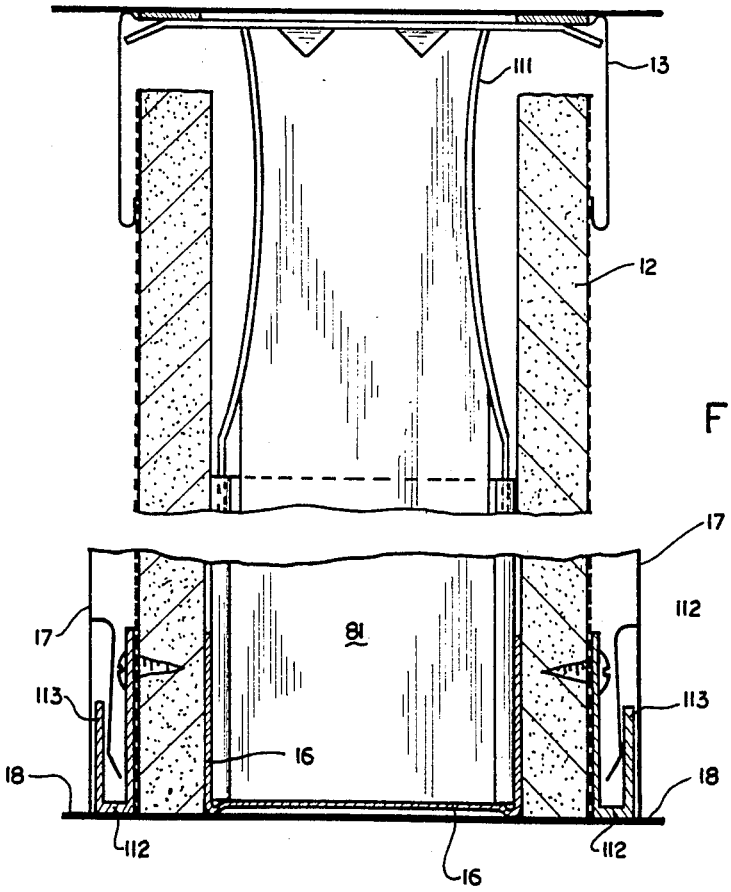
FIG. 8 is a vertical section, taken along line 8—8 of FIG. 1 and illustrating the stud, tracks, wall panels, and trim structure along the panelled portion of a wall.

FIG. 8 illustrates the manner in which the studs and panels interconnect with the tracks and the baseboard. As illustrated therein, the lower ends of the stud 81 fit into the floor track 16 and a stud extension 111 fits into the ceiling track 13. It should be noted that the floor track 16 is substantially narrower than the ceiling track 13 and the upper edges of the panels 12 extend inside the ceiling track while the lower edges of the panels are positioned on the outside of the floor track 16 and rest on the floor 18. A mounting clip 112 is fastened to the panels adjacent to the floor and provides an upstanding wall 113 which connects with the baseboard 17 in the same manner as the mounting of the baseboard along the windows, as illustrated in FIG. 2.

With this invention in which a jacking system is provided, it is possible to use preglazed standard-size windows even though the floor-to-ceiling spacing may vary from one location to another. Because the floor and ceiling trim follow the floor and ceiling line and are of uniform height, they automatically mask any variation in the floor-to-ceiling spacing.

Figure 6:
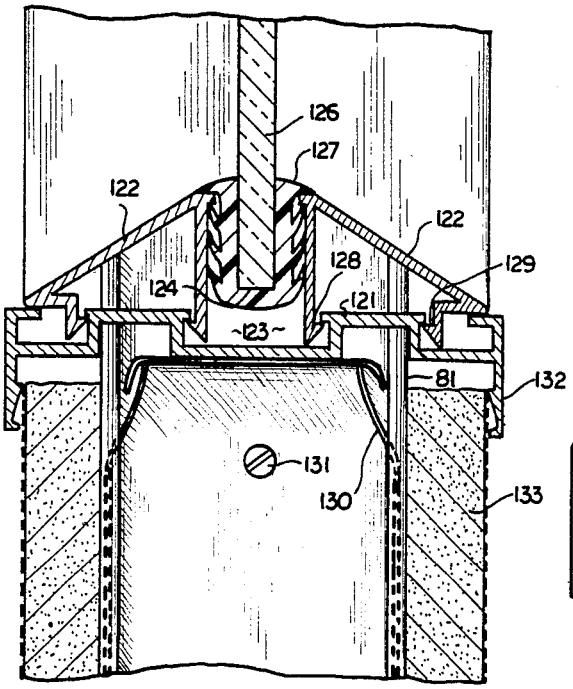
FIG. 6 is a fragmentary view of the base of a window which does not extend to the floor.

FIG. 6 illustrates the structure provided when windows are mounted above the floor level. In such instance, a modified bottom framing member 121 is provided. Such framing member, in combination with two side framing members 122, defines a longitudinally extending channel 123 which receives the lower edges 124 of the glass 126 of the window. Here again, a glazing seal 127 fits around the edges 124 of the glass and tightly fits into the channel to provide the glazing of the window.

The two side framing members 122 provide hooks 128 and 129 which releasably lock with the main framing member 121 in the assembly but which may be removed for disassembly when required. In this instance, a support piece 130 is provided which telescopes with the stud 81 and is secured thereto by a screw 131 to support the adjacent end of the framing member 121 at the proper height. Since a stud is provided at each side of the window, support is provided at each end of the framing member to support the window on the stud. In instances in which a wide window is involved, a short intermediate stud may be provided which extends only up to the window and is provided with a support clip 130 to provide intermediate support of the window framing system. The framing member 121 for such windows is provided with a depending skirt 132 along each lateral edge thereof which fits down over the upper edge of the adjacent panel 133 to provide a finished trim appearance along the bottom of the window. The sides and the tops of the window are formed with the same structure as illustrated in FIGS. 3 and 4, so the window is fully trimmed when installed.

In some instances, it is necessary to field-glaze a window, for example, when a window is broken and must be replaced. The present invention allows field glazing of a damaged window in accordance with the structure illustrated in FIG. 7. In such instance, the side plate 41 and baseboard 17 along one side of the window are removed and the secondary framing member 22 is removed from the primary framing member 21. A new piece of glass 141 is then installed in the following manner.

Figure 7:
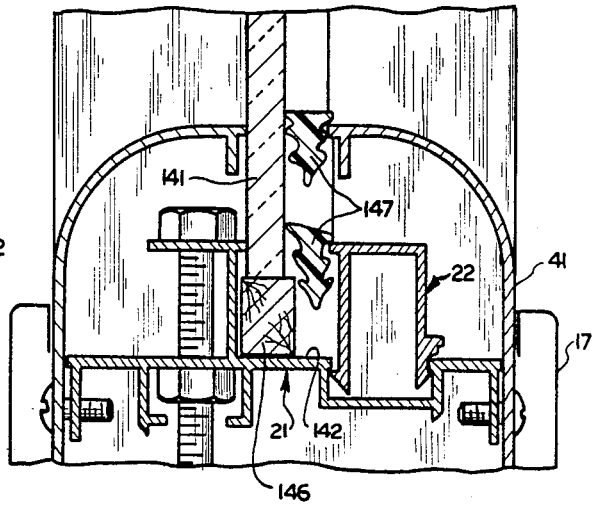
FIG. 7 is a fragmentary view illustrating a modified glazing system which may be used for glazing a window at the time of installation as distinct from factory glazing illustrated in the prior figures.

First, the lower edge of the window is placed on the surface 142 and one edge of the window is moved laterally into the side channel 77 along one side of the framing assembly. During such movement, the top edge of the glass is spaced below the channel 57 in the upper framing member 56 so that one side edge can be positioned in the side channel along its full length. The spacing between the inner wall 143 of one side framing member and the face of the opposite side framing member is greater than the width of the window being installed, so that the window can then be moved in to a position in alignment with the opposite channel 77 of the opposite framing member 76 and thereafter moved laterally until both side edges of the window are positioned in their associated channels 77 but are spaced from the inner walls a substantially equal amount. The window glass 141 is then raised up above the surface 142 and a block 146 is inserted between such surface and the lower edge of the glass, as illustrated in FIG. 7. Such block may be, for example, merely a wooden block. This raising of the glass causes the upper edge thereof to project into the upper channel 57 of the upper framing member 56.

The secondary framing member 21 is then snapped into position and a seal glazing strip 147 is positioned along one side of the glass to hold it over against the clearance provided in the channel. Such a seal glazing strip is installed also along the tops and sides of the window. The adjacent cover plate 41 and baseboard 17 are then reinstalled and a second piece of seal glazing strip 147 is installed between one side of the glass and the inner edge of the adjacent cover plate to complete the glazing operation.

For factory glazing, the glazing strip of FIGS. 2 through 6 is preferred, since it provides full suspension of the glass within the framing assembly. However, when field glazing is required, such a glazing strip is not easily managed and a glazing strip having a structure of the glazing strip 147 is preferable. As pointed out above, field glazing can be used to install a new window glass within an existing demountable wall structure without requiring that the window framing structure be removed from the wall for the glazing operation. It should also be noted, however, that in instances in which it is desired to perform field glazing at the time the wall is erected, the various framing members can be bolted together before installation and glazed as a bench operation in the field before installation of the window.

With the present invention, a fully integrated, demountable wall system is provided which combines wall panels and windows in substantially any desired manner. Further, with such system, an improved trim appearance is provided, and it is not necessary to custom-fit the various components of the window system to compensate for variations in floor-to-ceiling spacing. Further, because of the adjustability provided by the jacking system, standard size preglazed windows can be installed in virtually all instances, eliminating the requirement for custom sizing windows for a given installation.

Although the preferred embodiment of this invention has been shown and described, it should be understood that various modifications and rearrangements of the parts may be resorted to without departing from the scope of the invention as disclosed and claimed herein.

What is claimed is:

1. A demountable partition system extending between a floor and a ceiling, comprising floor and ceiling tracks respectively mounted on said floor and ceiling, studs extending between said tracks, wall panels supported by said tracks and studsk, and a floor-to-ceiling window providing top, side, and bottom framing means, said side framing means connecting with adjacent studs and partially enclosing said adjacent studs, said connection causing said adjacent studs to strengthen said side framing means, said top framing means connected with and being supported by said ceiling track, said bottom framing means including adjusting means for adjusting the height of said window with respect to said floor, and base trim following said floor and removably connected to said bottom framing means, said base trim enclosing and obscuring said adjusting means and accommodating variations in spacing between said bottom framing means and said floor by providing a uniform spacing between said floor and the lower edge of the exposed portion of glass even when said bottom framing means is inclined relative to said floor.

2. A demountable partition system as set forth in claim 1, wherein said ceiling track is a downwardly open channel, and said top framing means is structured to snap into said ceiling track channel and be substantially entirely positioned within said channel, said channel also receiving the upper ends of said panels and providing a uniform trim along both said panels and said window.

3. A demountable partition system as set forth in claim 2, wherein said base trim includes a baseboard providing a uniform trim extending along both said panels and said window.

4. A demountable partition system as set forth in claim 1, wherein said connection between said side framing means and said studs is provided by mounting clips mounted at intervals along said studs which provide latching means which connect with associated of said side framing means.

5. A window system for demountable walls in which said demountable walls include floor and ceiling tracks, and metal studs adapted to extend between said tracks and cooperate therewith to support wall panels, comprising a floor-to-ceiling window, bottom framing means glazed to the lower edge of said window, jacking means mounted on said framing means operable to engage said floor track and adjusting the height of said framing means relative to said floor track through a range of adjustments, and base trim means adapted to rest on the floor and removably connect to said bottom framing means in any position within said range of adjustment, said base trim means extending over said bottom framing means and said jacking means to a position adjacent said window to enclose and obscure said bottom framing means along with said jacking means, said base trim means including a cover member adapted to rest on said floor and enclose and obscure the connection between said bottom framing means and said base trim means, said base trim means providing a uniform width along the length thereof so that when said window is installed the lower edge thereof appears to be uniformly spaced from said floor even when said bottom framing means is inclined relative to said floor.

6. A window system for demountable walls as set forth in claim 5, wherein said base trim means includes a baseboard operable to extend along both said windows and said panels to provide a uniform trim along the entire position.

7. A window system for demountable walls as set forth in claim 6, wherein said baseboard encloses and obscures said connection between said base trim means and said bottom framing means.

8. A window system for demountable walls as set forth in claim 5, wherein said jacking means includes jackscrews threaded through said bottom framing means laterally to one side of said window, said jackscrews providing wrenching heads vertically accessible to permit ratchet-type wrenches to be used to adjust the height of said window.

9. A floor-to-ceiling window system comprising a ceiling track mounted on a ceiling, a window and frame therefor providing an upper frame member connected to said ceiling track, and a lower framing member, jacking means on said lower framing member operating to adjust the height of said window with respect to said floor through an adjustment range so that said upper frame member is properly positioned with respect to said ceiling track, cover plate means resting on said floor and removably connected to said lower framing member in any position within said range of adjustments, said cover plate means operating to enclose said lower frame member and jacking means along with a portion of said window above said frame member which varies with the adjustment of said jacking means, said cover plate means providing a lower window trim that follows the floor line and compensates for variations in floor-to-ceiling spacing by providing an appearance of a uniform spacing between the floor and the lower edge of the glass of the window even when said lower framing member is inclined with respect to said floor.

10. A window system as set forth in claim 9, wherein said frame provides a channel into which the edges of said window fit with clearance, and a glazing seal positioned around said window suspending said window in said channel, said lower frame member in cooperation with a removable member cooperating to provide a channel along the bottom of said window, removal of said removable member allowing installation of a replacement window without further disassembly of said frame.

* * * * *